US007140421B2

(12) United States Patent
Hsu

(10) Patent No.: US 7,140,421 B2
(45) Date of Patent: Nov. 28, 2006

(54) WICK STRUCTURE OF HEAT PIPE

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/934,589

(22) Filed: Sep. 3, 2004

(65) Prior Publication Data

US 2006/0048919 A1 Mar. 9, 2006

(51) Int. Cl.

| | |
|---|---|
| ***F28D 15/00*** | (2006.01) |
| ***F28D 15/02*** | (2006.01) |
| ***H05K 7/20*** | (2006.01) |
| ***H01L 23/427*** | (2006.01) |

(52) U.S. Cl. ..... 165/104.26; 165/104.21; 29/890.032

(58) Field of Classification Search ..... 165/104.26, 165/104.21; 29/890.032

See application file for complete search history.

(56) References Cited

U.S. PATENT DOCUMENTS

| | | | | |
|---|---|---|---|---|
| 3,576,210 | A * | 4/1971 | Trent | 165/104.26 |
| 3,921,710 | A * | 11/1975 | Katayama | 165/104.26 |
| 4,109,709 | A * | 8/1978 | Honda et al. | 165/104.26 |
| 4,489,777 | A * | 12/1984 | Del Bagno et al. | 165/104.26 |
| 4,557,413 | A * | 12/1985 | Lewis et al. | 228/183 |
| 5,785,088 | A * | 7/1998 | Pai | 138/38 |
| 6,427,765 | B1 * | 8/2002 | Han et al. | 165/104.26 |
| 6,619,384 | B1 * | 9/2003 | Moon et al. | 165/104.26 |
| 2001/0004934 | A1 * | 6/2001 | Yamamoto et al. | 165/104.11 |
| 2004/0112450 | A1 * | 6/2004 | Hsu | 138/38 |

FOREIGN PATENT DOCUMENTS

| | | | |
|---|---|---|---|
| JP | 57-207792 | * 12/1982 | 165/104.26 |
| JP | 60-259401 | * 12/1985 | |
| JP | 60259401 A | * 12/1985 | |

* cited by examiner

*Primary Examiner*—John K. Ford

(57) ABSTRACT

A wick structure is attached on an internal sidewall of a heat pipe. The wick structure includes a plurality of orthogonal woven fibers. The fibers extending along a longitudinal direction of the heat pipe are thinner; therefore the wick structure is capably of providing enhanced capillary action and good attachment to the heat pipe.

2 Claims, 5 Drawing Sheets

WICK STRUCTURE OF HEAT PIPE

BACKGROUND OF THE INVENTION

The present invention relates in general to a wick structure of a heat pipe, and more particularly, to a wick structure capably of providing enhanced capillary action and good attachment to a heat pipe.

There are lots of device used for transferring heat in the industry. A heat pipe is widely in the form of a tube with one closed end and one open end. A wick structure is installed in the heat pipe and a working fluid is introduced into the heat pipe, followed by the process of sealing the open end. When the heat pipe is in contact with the electronic products, the heat absorbing end absorbs the heat from the electronic products, such that a phase transition from the liquid state to the gas state occurs to the working fluid. After flowing to the cooling end of the heat pipe, the gaseous working fluid is then condensed back to the liquid state and re-flows back to the heat absorbing end by the capillary effect provided by the wick structure. Therefore, the circulation and phase transition of the working fluid irritated in the heat pipe provides enhanced heat dissipation performance, such that the electronic product can always operate under a uniform and working temperature.

However, the woven fibers of conventional wick structure have the same size. Therefore, both of good capillary force and well attaching capability providing by the wick structure can not be reached at the same time. That is because if the woven fibers of the wick structure are thicker, the wick structure provides weak capillary action. Alternatively, thinner woven fibers can provide good capillary action but can not provide good support to be attached on the internal sidewall of the tubular member of the heat pipe.

Thus, there still is a need in the art to address the aforementioned deficiencies and inadequacies.

BRIEF SUMMARY OF THE INVENTION

The present invention provides a wick structure of a heat pipe with different sized woven fibers. The woven fibers include a plurality of orthogonal transversal fibers and longitudinal fibers and the transversal fibers are thicker than the longitudinal fibers. When the wick structure is attached on the internal sidewall of the heat pipe, the longitudinal fibers are extended along the axial direction of the heat pipe. Therefore, the tubular heat pipe with one end contacted with the heat source can provide good capillary force to enhance the re-flowing rate of the working fluid filled in the heat pipe from the other end because of the thinner longitudinal fibers of woven wick. On the other hand, the thicker transversal fibers can provide more support to the longitudinal fibers so as to enhance the attachment of the wick structure to the heat pipe.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
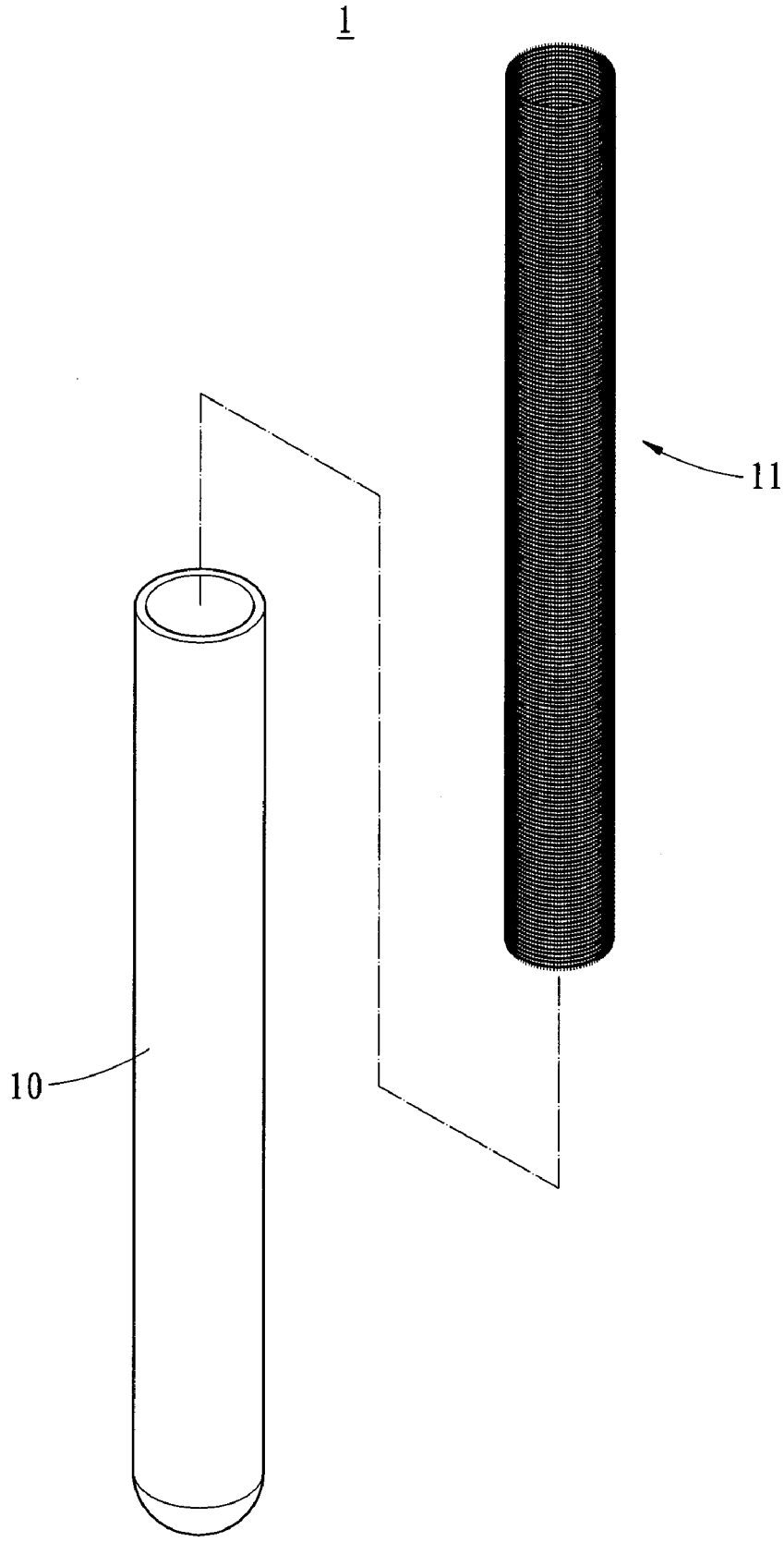
FIG. 1 shows an exploded view of a heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 2:
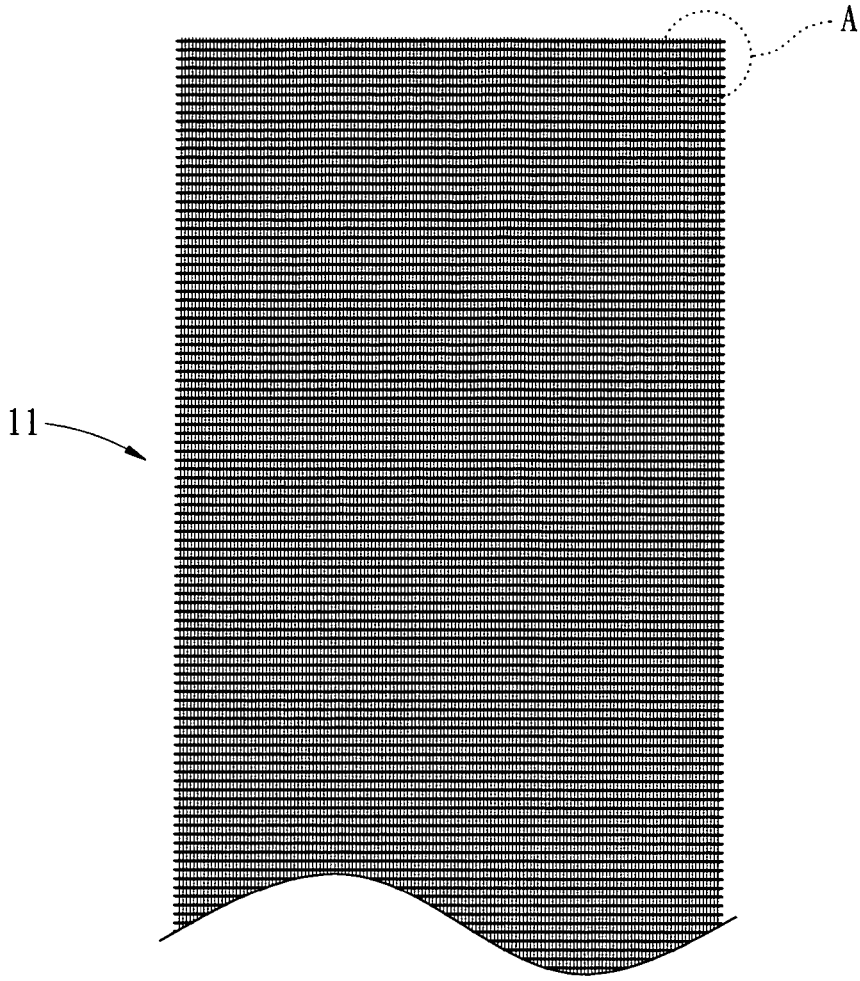
FIG. 2 shows an expanded view of a wick structure of the heat pipe according to the present invention.
Figure 3:
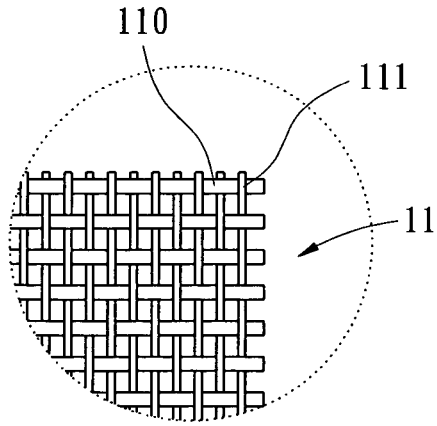
FIG. 3 shows an enlarged view of an A portion in FIG. 2.

Please refer to FIGS. 1 and 2, which respectively show an exploded view of a heat pipe and an expanded view of a wick structure according to the present invention. The heat pipe 1 includes a tubular member 10 with a wick structure 11 attached on the internal sidewall thereof. The wick structure 11 includes at least one layer of woven wick formed by a plurality of orthogonal fibers 110 and 111 as shown in FIG. 3. Such that, while the wick structure 11 is attached on the internal sidewall of the tubular member 10, the longitudinal fibers 111 are arranged extending along the axial direction of the tubular member 10. The woven fibers 110 and 111 are preferably made of metal material with higher thermal conductivity such as using copper lines to form a copper net of the woven wick.

In the present invention, as shown in FIG. 3, the transversal fibers 110 are thicker than the longitudinal fibers 111. As such, the transversal fibers 110 can provide more strength to support the longitudinal fibers 111 so that whole wick structure 11 can be more securely attached on the tubular member 10. One the other hand, since the longitudinal fibers 111 are thinner, when one end of the tubular heat pipe 1 is contacted with a heat source needed to be dissipated heat, larger capillary force will be obtained to provide enhanced re-flowing rate of the working fluid filled inside the tubular member 10 condensed from vapor to liquid on the other end; therefore, the heat transfer efficiency of the heat pipe 1 is enhanced.

Figure 4:
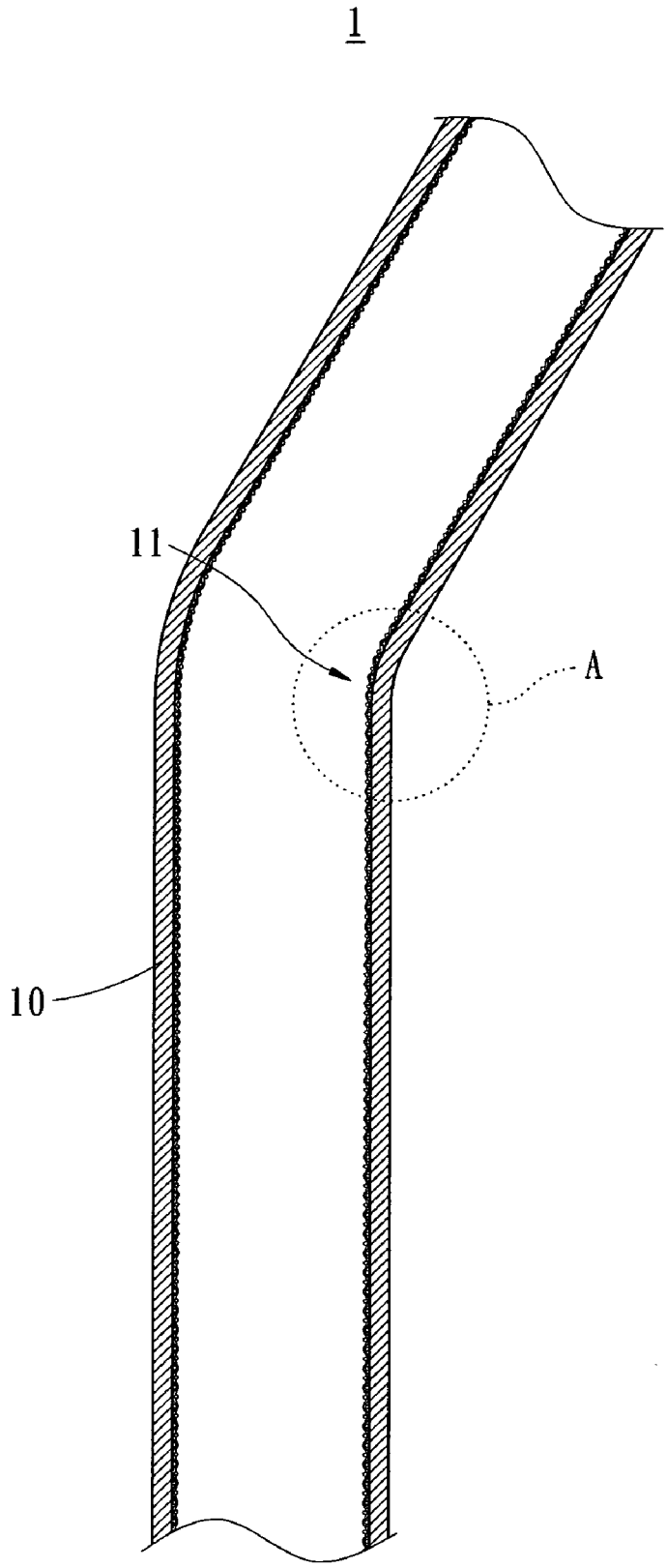
FIG. 4 shows a cross sectional view of a curved heat pipe with the wick structure provide by the present invention.
Figure 5:
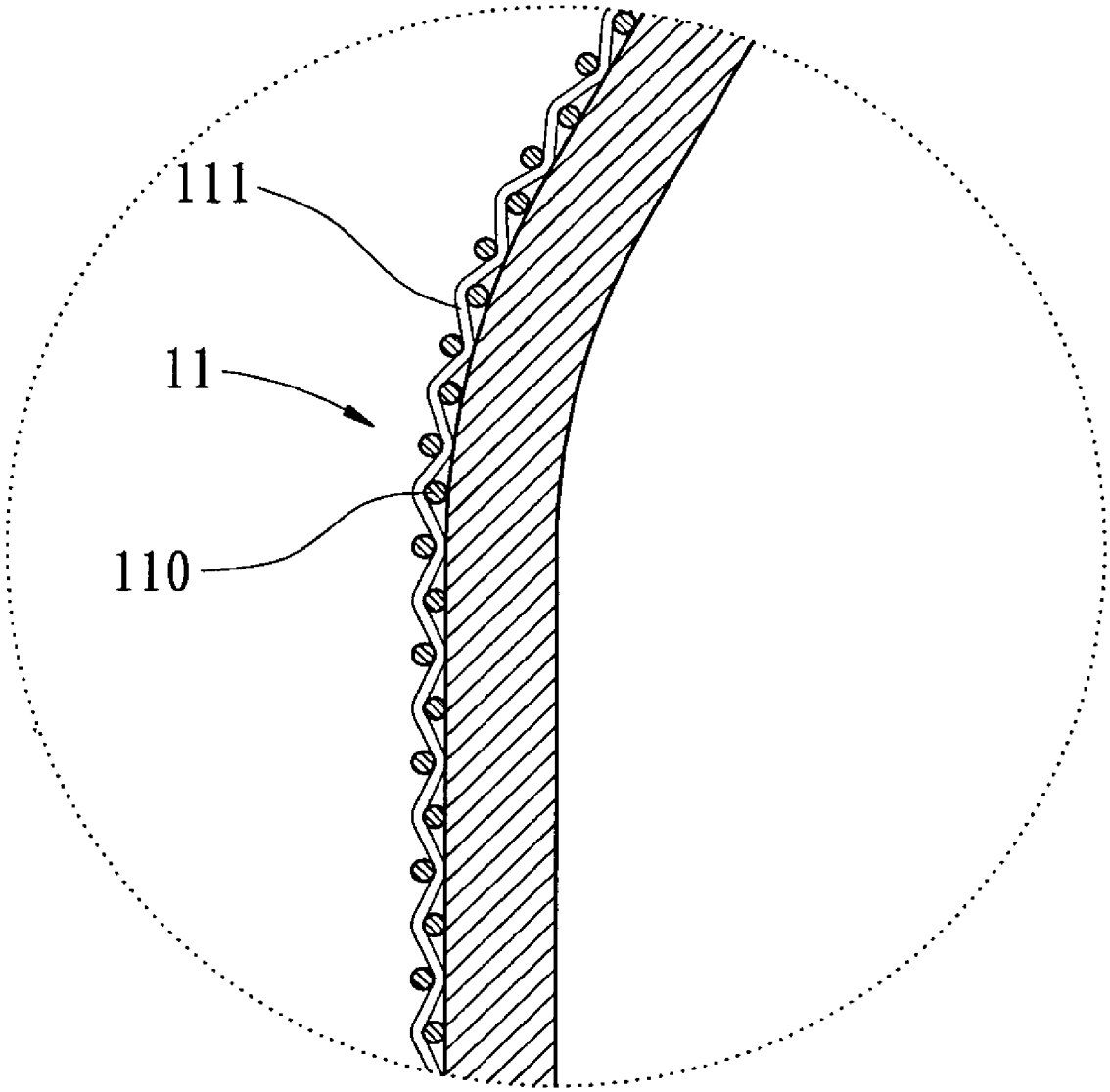
FIG. 5 shows an enlarged view of an A portion in FIG. 4.
Figure 6:
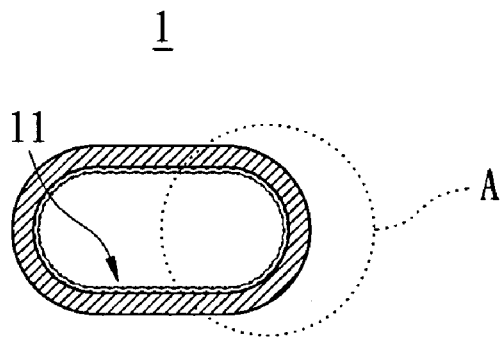
FIG. 6 shows a cross sectional view from an end of a non-rounded heat pipe with the wick structure provide by the present invention.
Figure 7:
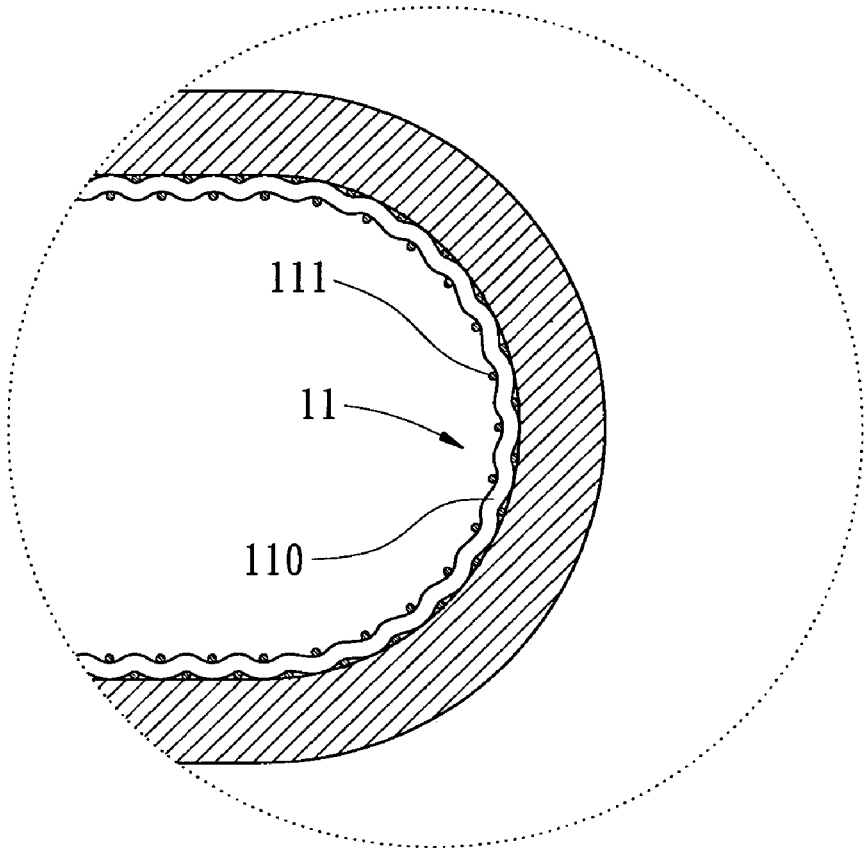
FIG. 7 shows an enlarged view of an A portion in FIG. 6.

The advantages of the wick structure 11 provided by the present invention will be shown in the following examples. As shown in FIGS. 4 and 5, the heat pipe 1 has curved tubular member 10. At the bended portion A of FIG. 5, the longitudinal fibers 111 have been reached. However, since the present invention provides thicker transversal fibers 110, the wick structure 11 still can be securely attached on the internal sidewall of the heat pipe 1. Furthermore, as shown in FIG. 6, the tubular member 10 of the heat pipe 1 is not rounded. Two corresponding sides of the tubular member 10 are pressed; therefore, in FIG. 7, the transversal fibers 110 have been more constrained at the curved portions. However, since the present invention provides thinner longitudinal fibers 111, the wick structure also still can be securely attached on the internal sidewall of the heat pipe 1.

This disclosure provides exemplary embodiments of wick structure of a heat pipe. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A wick structure attached on an internal sidewall of a heat pipe, comprising:

a plurality of longitudinal fibers extending along an axial direction of the heat pipe; and a plurality of transversal fibers thicker than the longitudinal fibers, orthogonally woven with the longitudinal fibers to form a one-layer wick so that the thicker transversal fibers provide more support to the longitudinal fibers to enhance the attachment of the wick to the heat pipe.

2. The wick structure of claim 1, wherein the fibers are made of copper.

* * * * *